United States Patent [19]

Newman et al.

[11] Patent Number: 4,884,599

[45] Date of Patent: Dec. 5, 1989

[54] APPARATUS FOR PACKAGING FLUID MATERIALS INTO PACKETS

[75] Inventors: Robert M. Newman, Decatur; Kenneth R. Warmath, Madison, both of Ala.

[73] Assignee: Ropak Manufacturing Company, Inc., Decatur, Ala.

[21] Appl. No.: 168,930

[22] Filed: Mar. 16, 1988

[51] Int. Cl.[4] ..... B65B 43/42; B67C 3/00

[52] U.S. Cl. ..... 141/1; 141/10; 141/103; 141/134; 141/144; 141/237; 222/170

[58] Field of Search ..... 141/144, 131, 132, 134, 141/242, 234, 237, 256, 105, 103, 106, 107, 1, 10; 222/170

[56] References Cited

U.S. PATENT DOCUMENTS

| | | | |
|---|---|---|---|
| 2,097,887 | 11/1937 | Lacey | 141/107 |
| 2,441,774 | 5/1948 | Shaw et al. | 141/131 |
| 3,152,622 | 10/1964 | Rothermel | 141/181 X |
| 3,578,778 | 5/1971 | Matthews et al. | 141/144 |
| 3,580,301 | 5/1971 | Najame et al. | 141/131 |
| 3,631,903 | 1/1972 | Huggins | 141/1 |
| 3,656,518 | 4/1972 | Aronson | 141/1 |
| 3,923,084 | 12/1975 | Matthews et al. | 141/144 |
| 4,338,982 | 7/1982 | Terminiello et al. | 141/132 |

FOREIGN PATENT DOCUMENTS

| | | | |
|---|---|---|---|
| 819974 | 11/1949 | Fed. Rep. of Germany | 141/132 |

*Primary Examiner*—Ernest G. Cusick

*Attorney, Agent, or Firm*—Jennings, Carter, Thompson & Veal

[57] ABSTRACT

A rotary packaging apparatus for non-free-flowing material synchronizes the discharge rate of material in an auger emptied hopper with the speed of rotation of a funnel carrying wheel which engages a continuous series of containers such that material is uniformly deposited in the packets. A plurality of hoppers may be provided to permit packaging more than one material into a packet.

14 Claims, 4 Drawing Sheets

APPARATUS FOR PACKAGING FLUID MATERIALS INTO PACKETS

FIELD OF THE INVENTION

The present invention relates to fluid material measuring and dispensing as applied to the packing and more particularly to the measuring and packaging of condiments and the like such as salt, cocoa, sugar, catsup and the like.

BACKGROUND OF THE INVENTION

The packaging art is replete with various devices utilized in the packaging of condiments.

U.S. Pat. No. 3,578,778 teaches employment of a rotating filling wheel or drum having a plurality of cam actuated trap chambers or traps mounted on the drum periphery and which drum holds the material to be packaged. Each trap fills with material, isolates one or more units of material and discharges material units into synchronized individual packets or containers to be filled. While a marked advance over the prior art, the trap operations have required many moving parts.

U.S. Pat. No. 3,631,903, over which this invention marks an improvement, resides around the concept of maintaining a supply of fluid material to be packaged in a rotatable drum, rotating the drum at some uniform speed in a constant direction, and simultaneously rotating a set of "traps", i.e., metering devices or trap chambers, which are arranged in a circular configuration and which are connected to and which rotate with the drum. Each trap provides an elongated, non-linear, material flow path between an inlet and outlet and in the embodiments disclosed in the patent such path is of helical shape. At a filling station each trap is positioned so that the material to be packaged is drawn from the drum through the trap inlet and so as to locate itself at one end of the helical path. As the valve rotates around the drum axis all material in excess of a unit of material is discharged through the inlet and the rotation causes the unit to move along the helical path and approach the trap outlet. As the trap reaches a separate discharge station, the unit of material reaches the end of its helical path and is discharged in synchronism with a packet or other container to be filled, mating with the trap outlet. Two or more such helical paths and two or more units of material may be discharged simultaneously.

U.S. Pat. No. 3,923,084 teaches retention of the basic filling drum technology of U.S. Pat. No. 3,631,903 including the use of spiral traps which meter a unit of material to be dispensed. The patent also teaches various improvements in feeding strip paper packets into position to receive the material from the drum.

Each of the foregoing apparatus described in these patents provided improvement in the packaging art, however, the utilization of such apparatus has revealed the need for changes. Specifically, the apparatus are somewhat limited in the materials which they can dispense and they cannot dispense plural products, i.e. packets with more than one product inside.

SUMMARY OF THE INVENTION

It is the principal object of the present invention to provide a method of high productivity packaging of non-free-flowing material.

Yet another object of the invention is to provide a method of high productivity packaging of more than one type material into the same package.

These and other objects of our invention are advantageously accomplished through a combination of features which substantially depart from the apparatus of the aforementioned patents. Our invention eliminates the use of the drum of the prior art as a holding station, thereby eliminating a considerable weight carrying requirement and providing a much more efficient system. In our apparatus the material to be packaged is stored in one or more hoppers wherein variable speed augers are employed to dispense the material at a controlled rate. The material is dispensed or discharged inside a rotating reel assembly which comprises a plurality of abutting funnel members. Each funnel member communicates with a filling spout which registers with one of a continuous series of packets, thus as the material is discharged from the hopper the rotating funnels separate the material and direct it into individual packets in accordance with the discharge rate and the rate of rotation of the reel assembly.

BRIEF DESCRIPTION OF THE DRAWINGS

Apparatus embodying features of our invention are depicted in the accompanying drawings which form a portion of this disclosure and wherein.

DESCRIPTION OF A PREFERRED EMBODIMENT

Figure 1:
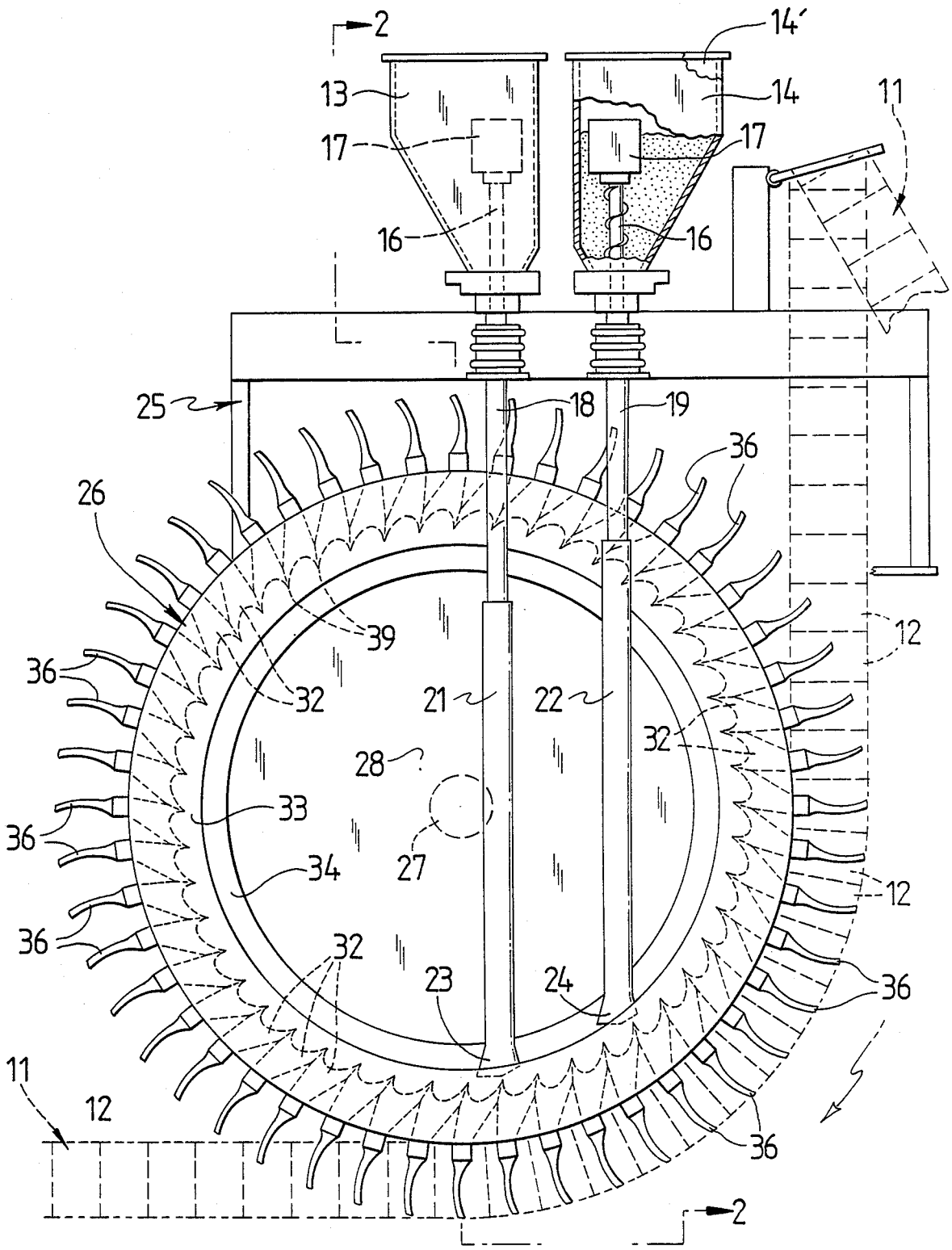
FIG. 1 is a side elevational view of such apparatus partially in section and partially broken away, with frame, support, and drive member eliminated for clarity.

Referring to the drawings it will be noted that the apparatus is depicted as configured to fill a continuous web 11 of packet elements 12 which is provided from a larger roller in the manner known in the prior art and illustrated for example in U.S. Pat. No. 3,923,084. It will be appreciated that various other types of containers may be filled using our apparatus and method. It is also to be understood that the drawings omit various commonly used structural members and connectors in the interest of clarity.

Figure 2:
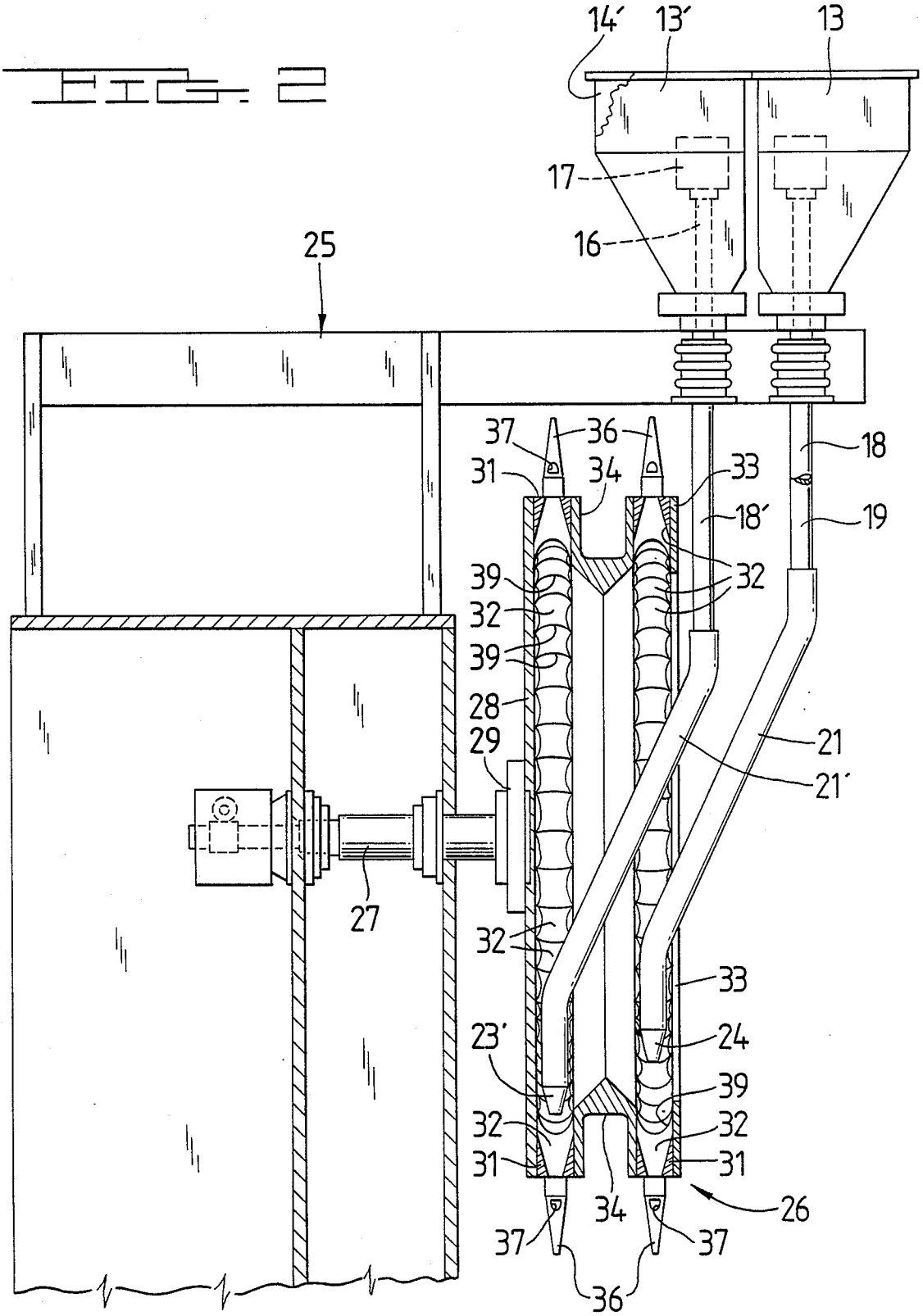
FIG. 2 is a sectional view, partially broken away taken along line 2—2 of FIG. 1.

Referring to FIGS. 1 and 2, it may be seen that our invention utilizes at least one hopper 13 and may use additional hoppers 13', 14 and 14' (not shown), wherein the material to be packaged is stored. Mounted within each hopper 13-14' is an auger 16 driven about a vertical axis by a variable speed motor 17. The auger 16 removes material, which may be less than fluid and thus not free-flowing into an associated dispensing tube 18-19' which is in communication with the bottom of the hopper 13-14' respectively. Each dispensing tube 18-19' connects to an outlet conduit 21-22' which extends downwardly and laterally from the dispensing tubes 18-19'. Each outlet conduit has an end portion 23-24' which is deformed from round to form an oval or other elongated shape such that each defines a region in which material from the hopper 13-14' is discharged.

Figure 3:
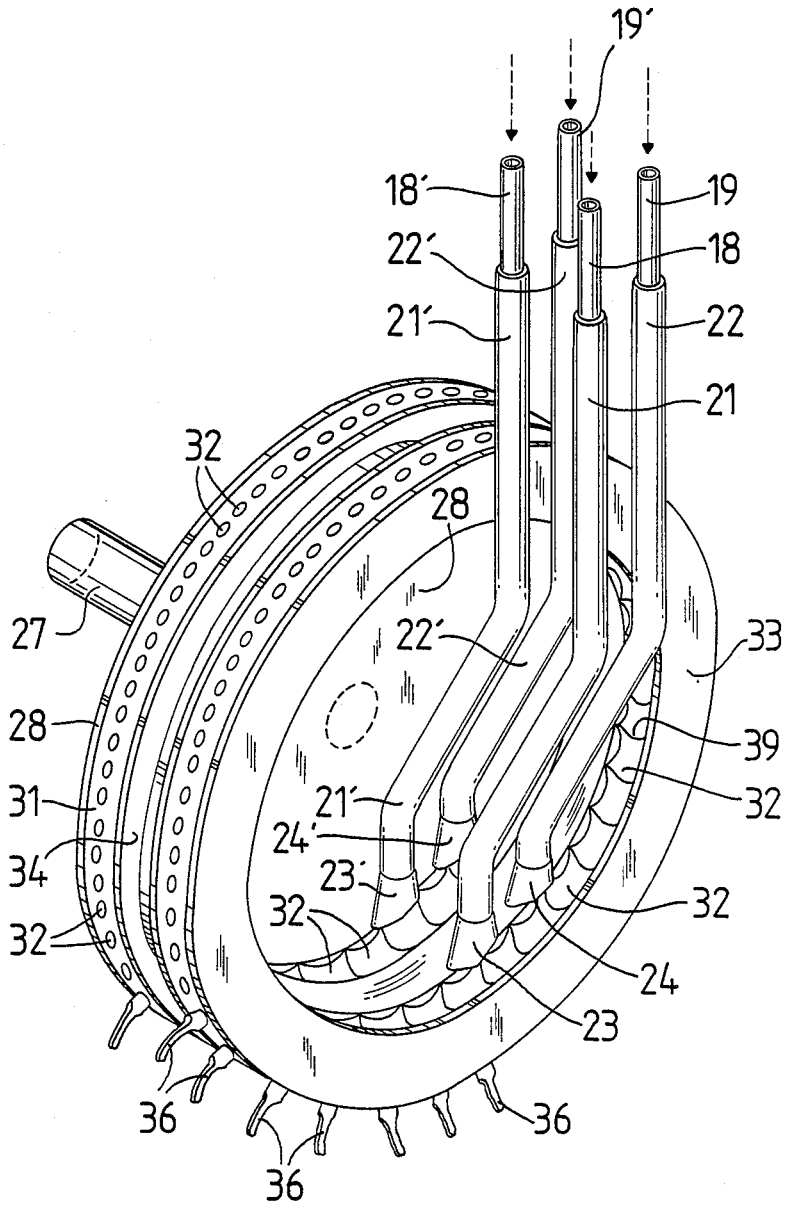
FIG. 3 is a perspective view of the apparatus shown in FIG. 1.

In FIGS. 1-3, we have depicted a reel assembly 26 mounted for rotation on a drive shaft 27 which is driven by a variable speed motor conventionally as is known in the art. The drive shaft 27 is mounted horizontally in the frame 25 of our apparatus and carries the reel assembly 26 such that it rotates beneath the end portions 23-24 within the discharge region. The reel assembly 26 depicted is a dual pack assembly which permits the simultaneous filling of packets 12 in parallel webs 11. Clearly, the reel assembly 26 may be designed to fill packets from one or more webs 11. The reel assembly 26 includes disc-like member 28 affixed to a hub 29 on the end of drive shaft 27. Affixed to the hub 29 is a funnel wheel 31 which has formed therein a plurality of contiguous funnels 32 which extend generally radially through the funnel wheel 31 with their larger ends facing inwardly. A ring 33 may be affixed to the outer side of the funnel wheel 31 or a spacer 34 may be affixed thereto and to a second funnel wheel 31 as shown in the FIGS.

Each funnel wheel 31 carries a plurality of filling spouts 36 each communicating with a funnel 32 and extending generally radially outwardly from the funnel wheel 31. The filling spouts are generally cylindrical proximal the funnel wheels 31 and taper therefrom to facilitate entry into the packets 12 of the webs 11, however the discharge ports 37 of the spouts are located at the junction of the cylindrical portion and the tapered portion thereof.

It will be noted in FIG. 2 that the longitudinal axis of the end portion 23' is vertically aligned with centerline of the funnels 32 and the filling spouts 37, thus material discharged from the outlet conduit 22 can pass directly through the reel assembly 26. The elongated end portions 23, 24, 23', 24' are narrower than the tops of the funnels 32, thus material passing through the discharge region defined by the end portion is not accumulated above the funnels but is passed directly into the funnels. As may be seen best in FIG. 1 and FIG. 3, outlet conduits 21 and 22 and 21' and 22' lie in the same vertical plane, thus as the funnel wheel 31 rotates each funnel 32 passes first beneath end portion 24 or 24' then beneath end portion 23 or 23'. The packets 12 engage the filling spouts 36 near the 3 o'clock position on the reel assembly 26 and thus are positioned to receive material as the web 11 traverses the periphery of the reel assembly 26 beneath the discharge region.

Figure 4:
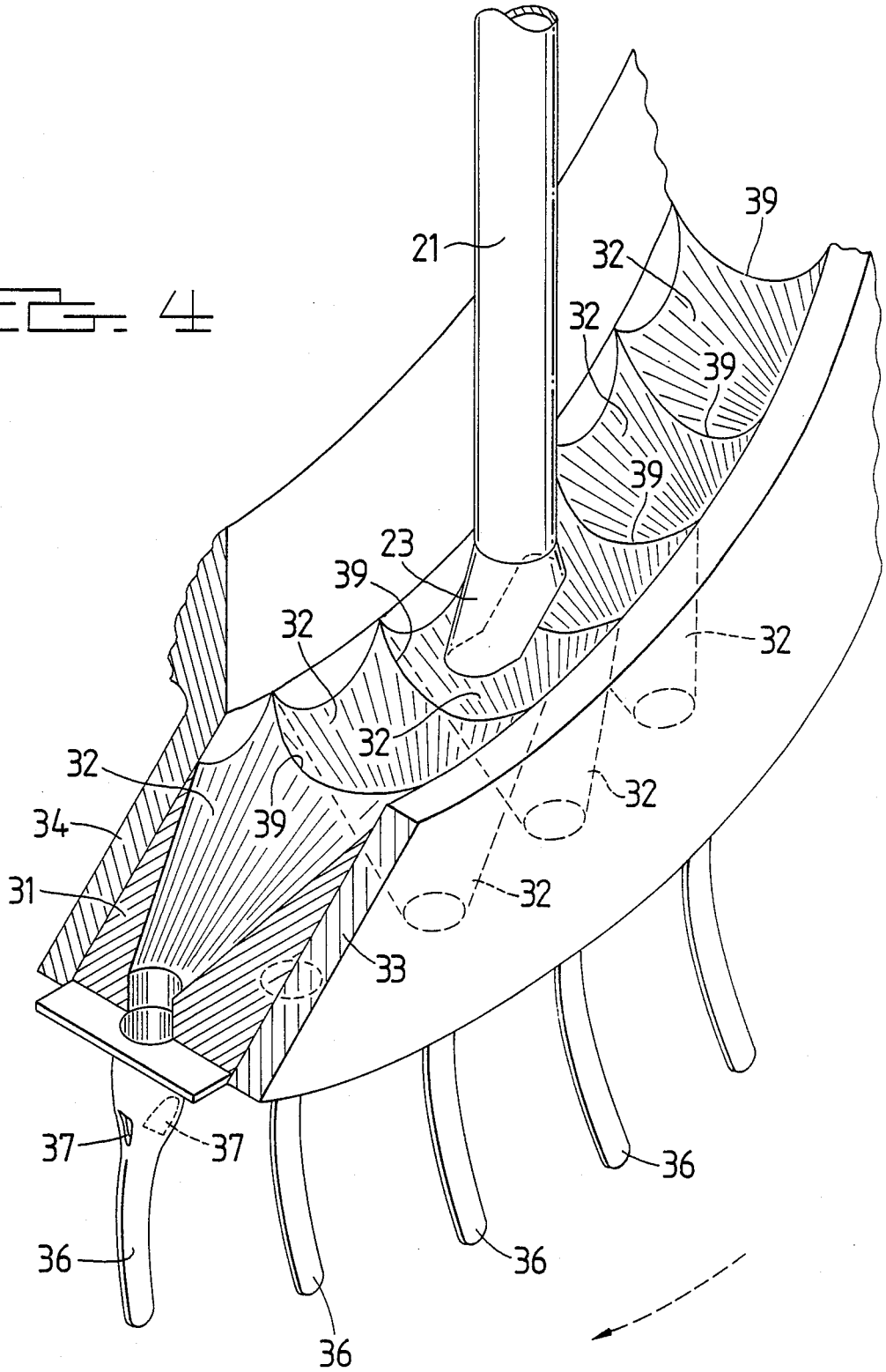
FIG. 4 is a detail view of the funnel construction.

With reference to FIGS. 1, 2, and 4, it is noteworthy to mention the construction of the funnel wheel 31. The funnel wheel 31 comprises one or more segments formed into an annulus whose radial thickness is less than that of ring 33. Each funnel 32 defines a conic whose axis is tilted in the plane of the funnel wheel at an angle of about 20° from a radius taken through the center of the associated fill spout 36. The conic surface of adjacent funnels intersect forming a curvilinear or crescent shaped boundary 39 transversely between the spacer 34 and the hub 28 or ring 33. Thus, the adjacent funnels 32 are sharply divided providing clear cut-off lines between funnels 32. The conic surface of the funnels 32 also intersect the side walls of the funnel wheel 31 such that an arcuate edge is formed. Thus when the funnel wheel 31 is affixed into the reel assembly 26 the hub 28 and ring 31 form the inner side walls of the funnels 32.

With the foregoing in mind, the operation of our apparatus is readily understood. Each hopper 13-14' contains a material to be dispensed into one of the packets 12. For example, hoppers 13 and 13' may contain sugar or a dried dairy creamer while hoppers 14 and 14' may contain cocoa. It will be appreciated that cocoa, or dairy creamer, tends to bridge or pack so that it may not flow freely from within the hopper. It will also be appreciated that any attempt to combine the contents of hopper 13 with that of hopper 14 in a single pack would be beyond the ability of the drum-type devices of the prior art, however, such combination is readily achieved in the instant invention. The contents of each hopper 13-14' are removed through the tubes 18-19' by the respective augers 16 at a selected rate such that there is a constant flow of material from the hopper through the end portions 23-24'. The separate augers permit the material in hopper 13 to be removed at a different rate than the material in hopper 14. The material is discharged under the influence of gravity and the auger downwardly into a discharge region defined by the end portions 23-24'. The reel assembly rotates through the discharge regions thus sequentially carrying the funnels 32 through the downward flow of material at a preselected speed. Each funnel 32 channels the discharged material into its filling spout 36 which is inserted within a packet 12. The funnels 32 and spouts 36 provide a direct path from the end portion to the packets 12. Thus any material entering the funnel 32 continues through the funnel 32 to the packet, It should thus be clear that the amount of material in a packet 12 is a function of the rate of flow of the material and the speed of rotation of the reel assembly 26. In as much as each funnel 32 is in the discharge regions for the same period of time an equal amount of material is directed to each packet 12, however since the rate of flow from each hopper 13-14' can be independently selected, any ratio of the materials combined in the packet 12 can be selected by adjusting the rate of discharge of the material from their respective hoppers 13-14'. Further the peaked construction of the funnels 32, providing the sharp delineation at boundary 39 between adjacent funnels, assures that each funnel receives the same quantity in a discharge region and prevents spillage or accumulation between funnels.

While we have shown our invention in one form, it will be obvious to those skilled in the art that it is not so limited but is susceptible of various changes and modifications without departing from the spirit thereof.

What we claim is:

1. Apparatus dispensing fluids in uniform units for packaging into separate containers comprising:

(a) means defining a plurality of aligned discharge regions for discharging said fluids therethrough at a preselected rate;

(b) a plurality of uniformly and annularly spaced funnel elements, each funnel element having a larger end having an area larger than said discharge region and a smaller end mounted for sequential rotation about a central axis with said larger ends facing radially inwardly such that each funnel elements passes sequentially beneath said discharging means through said aligned discharge regions during said rotation;

(c) means for rotating said plurality of funnel elements at a predetermined angular speed such that each funnel element receives a predetermined quantity of said fluids as it passes through said discharge region;

(d) a plurality of discharge elements communicating with said plurality of funnel elements with each discharge element extending generally radially outwardly from said smaller end of said funnel elements;

(e) means for guiding a series of said separate containers into engagement with said discharge elements proximal said discharge region whereby said predetermined quantity of said fluid is discharged into each of said separate containers, with each of said separate containers having an open end adapted to receive discharge elements therewith during said engagement therewith.

2. Apparatus as defined in claim 1 wherein said means for discharging said fluids comprises:

(a) at least one hopper containing a quantity of said fluid;

(b) at least one dispensing tube communicating with an associated hopper and having an open end defining said discharge region; and (c) a driven auger mounted within each hopper for feeding said fluids into said dispensing tube at a preselected rate.

3. Apparatus dispensing fluids in uniform units for packaging into separate containers comprising:

(a) means defining a discharge region for discharging said fluids therethrough at a preselected rate including at least one hopper containing a quantity of said fluid; a dispensing tube communicating with each hopper and having an open end defining a discharge region, and a driven auger mounted within each hopper for feeding said fluids into said dispensing tube at a preselected rate;

(b) a plurality of uniformly and annularly spaced funnel elements, each funnel element having a larger end and a smaller end mounted for sequential rotation about a central axis with said larger ends facing radially inwardly such that each funnel element passes beneath said discharging means through said discharge region during said rotation, said plurality of funnel elements comprising a disc mounted for rotation about a horizontal axis, a planar ring spaced from said disc and supported thereon for concomitant rotation therewith, and a funnel wheel interposed between said disc and ring having a plurality of conic apertures extending generally radially therethrough;

(c) means for rotating said plurality of funnel elements at a predetermined angular speed such that each funnel element receives a predetermined quantity of said fluid as it passes through said discharge region;

(d) a plurality of discharge elements communicating with said plurality of funnel elements with each discharge element extending generally radially outwardly from said smaller end of said funnel elements;

(e) means for guiding a series of said separate containers into engagement with said discharge elements proximal said discharge region whereby said predetermined quantity of said fluid is discharged into each of said separate containers, with each of said separate containers having an open end adapted to receive said plurality of discharge elements therewithin during said engagement therewith.

4. Apparatus as defined in claim 3 wherein each conic aperture has its axis inclined at an angle of about 20° from the radius of said funnel wheel.

5. Apparatus as defined in claim 3 wherein said dispensing tube extends within said ring to a point intermediate said ring and said disc such that fluids flowing through said tube are directed downwardly therebetween.

6. Apparatus dispensing fluids in uniform units for packaging into separate containers, comprising:

(a) means defining a discharge region for discharging fluids therethrough at a preselected rate;

(b) a plurality of uniformly and annularly spaced funnel elements, each funnel element having a larger end and a smaller end mounted for sequential rotation about a central axis with said larger end facing radially inwardly such that each funnel element passes beneath said discharging means through said discharge region during said rotation, said plurality of funnel elements comprising a disc mounted for rotation about a horizontal axis, a planar ring spaced from said disc and supported thereon for concomitant rotation therewith, and a funnel wheel interposed between said disc and ring having a plurality of conic apertures extending generally radially therethrough;

(c) means for rotating said plurality of funnel elements at a predetermined angular speed such that each funnel element receives a predetermined quantity of said fluids as it passes through said discharge region;

(d) a plurality of said discharge elements communicating with said plurality of funnel elements with each discharge element extending generally radially outwardly from said smaller end of said funnel elements;

(e) means for guiding a series of said separate containers into engagement with said discharge elements proximal said discharge region whereby said predetermined quantity of said fluid is discharged into each of said separate containers, with each of said separate containers having an open end adapted to receive said plurality of discharge elements therewithin during said engagement therewith.

7. Apparatus as defined in claim 6 wherein each conic aperture has its axis inclined at an angle of about 20° from the radius of said funnel wheel.

8. Apparatus as defined in claim 6 wherein said means for discharging includes at least one conduit extending within said ring to a point intermediate said ring and disc such that fluids are discharged into said conic apertures as they pass therebeneath.

9. Apparatus for dividing fluid material into uniform units for packaging comprising:

(a) a reel assembly having a plurality of annularly spaced funnel elements formed therein with said funnel elements tapering toward the periphery of said reel assembly;

(b) means for rotating said reel assembly about a horizontal axis at a predetermined angular speed;

(c) means for dispensing fluids within said reel assembly through a plurality of defined and aligned regions smaller than each funnel element such that a predetermined quantity of each fluid is dispensed into each funnel element as said element passes sequentially beneath said defined region; and (d) means for guiding a continuous series of containers past reel assembly in synchronous motion therewith such that each funnel element registers with one of said containers while said defined quantity of fluid is dispensed thereinto to direct said defined quantity of fluid into said container.

10. Apparatus as defined in claim 9 wherein said means for dispensing said fluids comprises:

(a) at least one hopper containing a quantity of said fluid;

(b) a dispensing tube depending from each said at least one hopper and having an open end defining a discharge region internally of said reel assembly; and (c) a driven auger mounted with in each hopper for feeding said fluids into said dispensing tube at a preselected rate.

11. Apparatus as defined in claim 9 wherein said means for dispensing fluids comprises a plurality of hoppers each having an auger and a dispensing tube with each dispensing tube defining a discharge region within said reel assembly.

12. Apparatus for dividing fluid material into uniform units for packaging comprising:

(a) a reel assembly having a plurality of annularly spaced funnel elements formed therein with said funnel elements tapering toward the periphery of said reel assembly, said reel assembly comprising a disc mounted for rotation about to horizontal axis, a planar ring spaced from said disc and supported thereon for concomitant rotation therewith and, a funnel wheel interposed between said disc and ring, having a plurality of conic apertures extending generally radially therethrough to define said funnel elements;

(b) means for rotating said reel assembly at a predetermined angular speed;

(c) means for dispensing fluids within said reel assembly in a defined discharge region, smaller than each said funnel element, such that a defined quantity of said fluid is dispensed into each funnel element as each said element passes beneath said means for dispensing including at least one hopper containing a quantity of said fluid, a dispensing tube depending from each said at least one hopper and having an open end defining said discharge region, and a driven auger mounted within said hopper for feeding said fluids into each said dispensing tube at a preselected rate; and (d) means for guiding a continuous series of containers past reel assembly in synchronous motion therewith such that each funnel element registers with one of said series of containers while said defined quantity of fluid is dispensed thereinto to direct said defined quantity of fluid into said one of said series of containers.

13. A method of dispensing two or more materials into individual containers comprising:

(a) dispensing each material at a predetermined rate within a separate defined region of limited volume;

(b) rotating a plurality of continuous annularly spaced funnel elements, each having a volume greater that each defined region, about a central horizontal axis such that each funnel element passes sequentially through each of said defined regions at a predetermined rate of speed to receive a defined quantity of each material therewithin; and (c) continuously moving a series of fill containers into registry with said funnel elements proximal said defined region such that the defined quantity of materials received into said funnel elements is directed into said fill containers.

14. The method of claim 13 wherein the defined quantity of said material is varied by varying the relative movement between the funnel elements and the material being dispensed.

* * * * *